US005988096A

United States Patent [19]

Benesch et al.

[11] Patent Number: 5,988,096

[45] Date of Patent: Nov. 23, 1999

[54] TOW SUB

[76] Inventors: Daniel Benesch, P.O. Box 141655, Anchorage, Ak. 99514; David Kaufman, 1464 Bluebell Dr., Livermore, Calif. 94550

[21] Appl. No.: 09/165,018

[22] Filed: Oct. 1, 1998

[51] Int. Cl.[6] ..... B63B 21/66

[52] U.S. Cl. ..... 114/244; 114/253; 114/315

[58] Field of Search ..... 114/315, 271, 114/274, 253, 254, 242, 244, 312, 313

[56] References Cited

U.S. PATENT DOCUMENTS

| | | | |
|---|---|---|---|
| 3,084,654 | 4/1963 | Rosenberg et al. | 114/315 |
| 3,131,664 | 5/1964 | McInvale | 114/315 |
| 3,204,596 | 9/1965 | Fallon | 114/315 |
| 4,946,412 | 8/1990 | Maruo et al. | 441/135 |
| 5,178,090 | 1/1993 | Carter | 114/315 |

*Primary Examiner*—Stephen Avila
*Attorney, Agent, or Firm*—Michael J. Tavella

[57] ABSTRACT

A tow sub that has a bullet-shaped shell to cover the front of a diver. The shell is large enough to be comfortable for a diver lying in the shell. The shell has lenses that provide ample vision for the diver. The tow sub has two independent control surfaces. The first, is a fixed dive plane that can be attached to the top, sides or bottom of the shell. This dive plane acts as a diving plane. The second is a pivoting rear elevator control surface that is mounted on a tail boom. The pivoting elevator is controlled from within the shell by a yoke controller. The tow sub has a tow hook that has a quick release mechanism. Using this mechanism, the diver can disconnect the sub from the tow line from within the shell. When disconnected in this way, the sub stops and slowly rises to the surface.

20 Claims, 11 Drawing Sheets

TOW SUB

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to towable submarines for scuba divers and particularly to towable submarines for divers that have partial enclosures for the diver.

2. Description of Related Art

Towable submarines for divers are devices that allow scuba divers to be towed through the water at high speeds. Today, most designs of diver tow systems are really flat platforms that a diver reclines upon while a surface vessel tows the platform. One use for such tow craft is surveying or searching the ocean floor. While the tow boat follows a predetermined search pattern on the surface, the diver can pilot the tow craft (or tow sub) over the bottom to search, without having to constantly swim.

An example of a typical tow sled is found in U.S. Pat. No. 3,931,777 to Colgan. This design has a flat platform, a towing ring, control surfaces and a tilted "windshield." Although this design works, it has several limitations. Because the diver has little protection, the sled can be towed only at low speeds (typically less than 2 knots). Also, the tilted windshield tends to cause turbulence in the area behind the windshield. This causes considerable discomfort for a diver, especially when the speed of the sled increases. Moreover, the backwash breaks up the diver's air bubbles and swirls them forward. This obscures the diver's vision, which not only undermines the purpose of the tow sled, but can also be dangerous for the diver.

BRIEF SUMMARY OF THE INVENTION

The present invention overcomes all of these problems. It has a bullet-shaped shell that covers the front of the diver. The shell is large enough to be comfortable for a diver lying in the shell. The shell has clear lenses that give ample vision for the diver. The tow sub has two interdependent control surfaces. The first, is a dive plane that is attached to the top of the shell. The angle of this dive plane is fixed during operation. However, in some cases, the dive plane may be adjustable and can be set before the dive. This dive plane acts as a diving plane. The second is a pivoting rear elevator control surface that is mounted on a tail boom. The pivoting elevator is controlled from within the shell by a yoke controller or control stick, by use of diver foot stirrups, or by similar type systems. The tow sub has a tow hook that has a quick release mechanism. Using this mechanism, the diver can disconnect the sub from the tow line from within the shell. When disconnected in this way, the sub stops and slowly rises to the surface.

DETAILED DESCRIPTION OF THE INVENTION

Figure 1:
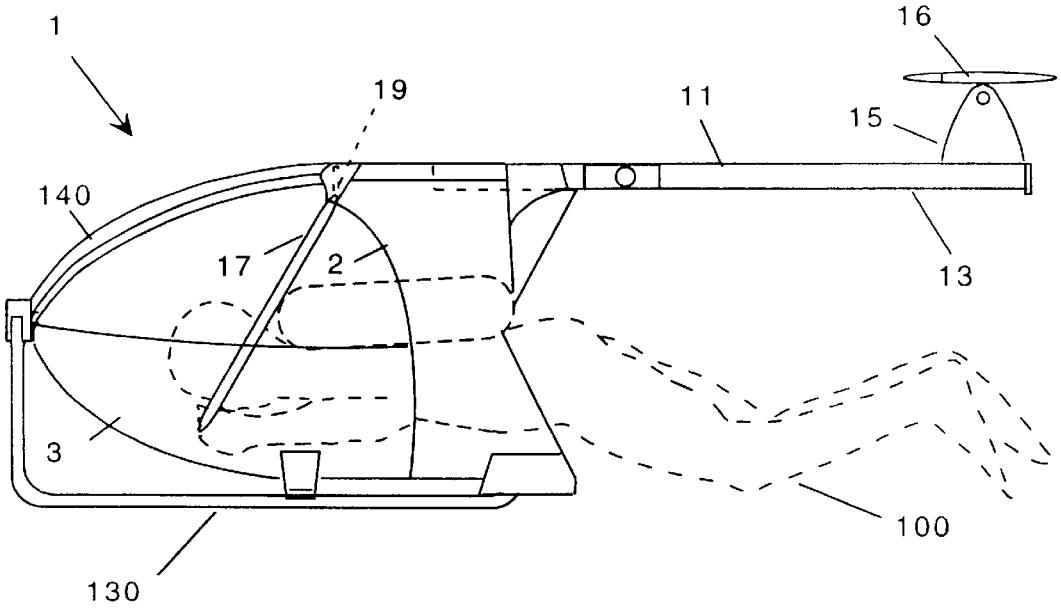
FIG. 1 is side elevation view of my tow sub with the dive plane removed and a diver in position.

Referring now to FIGS. 1, 2, 3 and 4 my new tow sub 1 is shown. The tow sub has a forward cockpit 2 that is generally bullet shaped and has an open back. The cockpit 2 is sized to hold a reclining diver 100. In the preferred embodiment, the cockpit 2 has large lens panels 3 that are made of polycarbonate or acrylic resins, a high strength clear plastic, or similar material. The lenses 3 are secured (clipped) to the sub body 2, along the aft edge of the lenses as shown. The lenses 3 meet in the center as shown, where they are secured to the tow bar 140, as discussed below. The use of the lenses as described provides a completely unobstructed view for the diver.

The tow sub components are assembled using quick disconnect type fittings. These fittings (not shown) are common fasteners in the art. In this way, the tow sub 1 can be easily assembled or disassembled for transport without the need for tools. Of course standard fasteners, such as bolts and nuts can be used for the fasteners, but these are not preferred because these fasteners require tools for assembly or disassembly.

At the top of the cockpit 2 is a dive plane 10. The dive plane 10 can be a solid piece. In the preferred embodiment, however, the dive plane is made of two sections, 10*a* and 10*b*. Of course, the dive plane 10 can be made of one solid piece, if so desired. The dive plane 10 provides downward thrust and stability for the sub during forward movement. A boom 11 attaches to the top of the cockpit 2. See FIG. 2. In the preferred embodiment, the dive planes 10*a* and 10*b* are attached to the flat part of the cockpit 2 as shown See FIGS. 3 and 4. Note that the shape of the dive planes shown is not exclusive. For example, dive planes might take on a "delta" wing design, if so desired. Moreover, the dive plane 10 can be attached to the sides of the cockpit, as shown in FIG. 3*a*, or can be attached to the bottom of the cockpit, as shown in FIG. 3*b*.

The dive planes shown also have handholds 150 that are used for ground handling of the sub. If course, the handholds are not necessary for the operation of the tow sub 1 and can be deleted. In the preferred embodiment, the dive planes are made of a composite sandwich construction using fiber reinforced plastics (FRP), such as fiber glass, kevlar, carbon fiber materials and the like.

Figure 2:
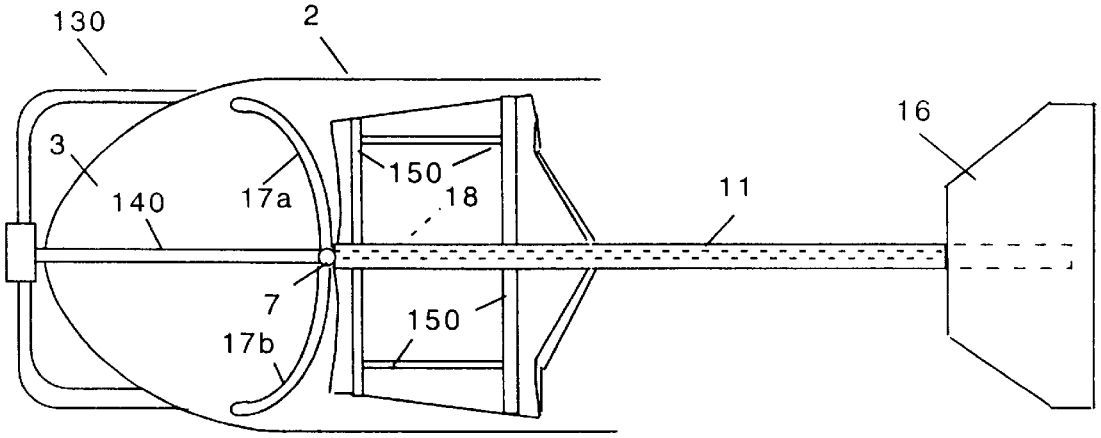
FIG. 2 is a top plan view of my tow sub with the dive plane removed, showing the internal framing.
Figure 3:
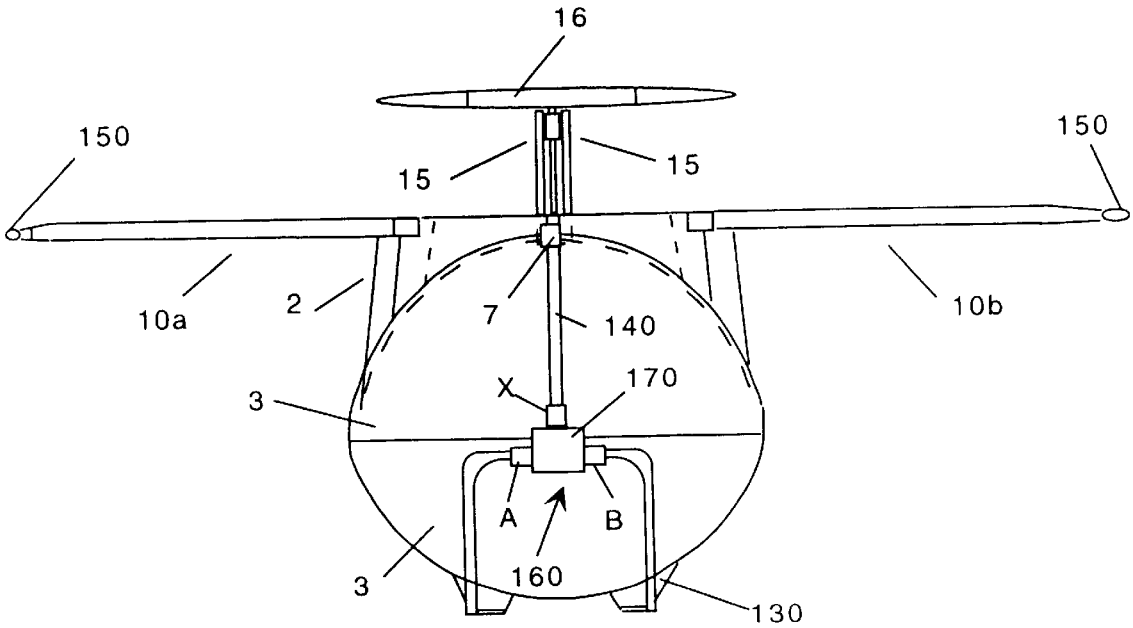
FIG. 3 is a front elevation view of my tow sub with the dive plane in place on the top of the sub.
Figure 3A:
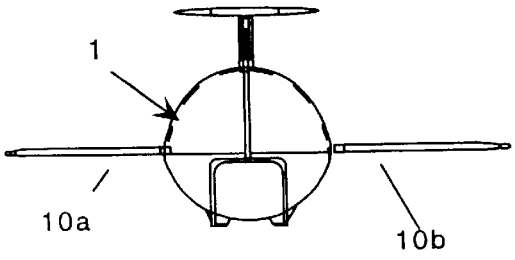
FIG. 3*a* is a front elevation view of my tow sub with the dive planes in place on the sides of the sub.
Figure 3B:
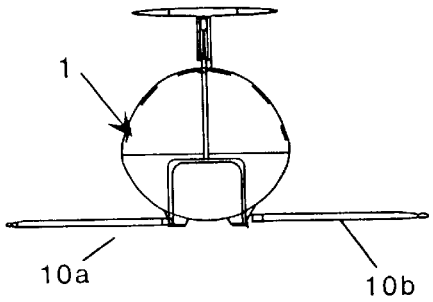
FIG. 3*b* is a front elevation view of my tow sub with the dive plane in place on the bottom of the sub.
Figure 3C:
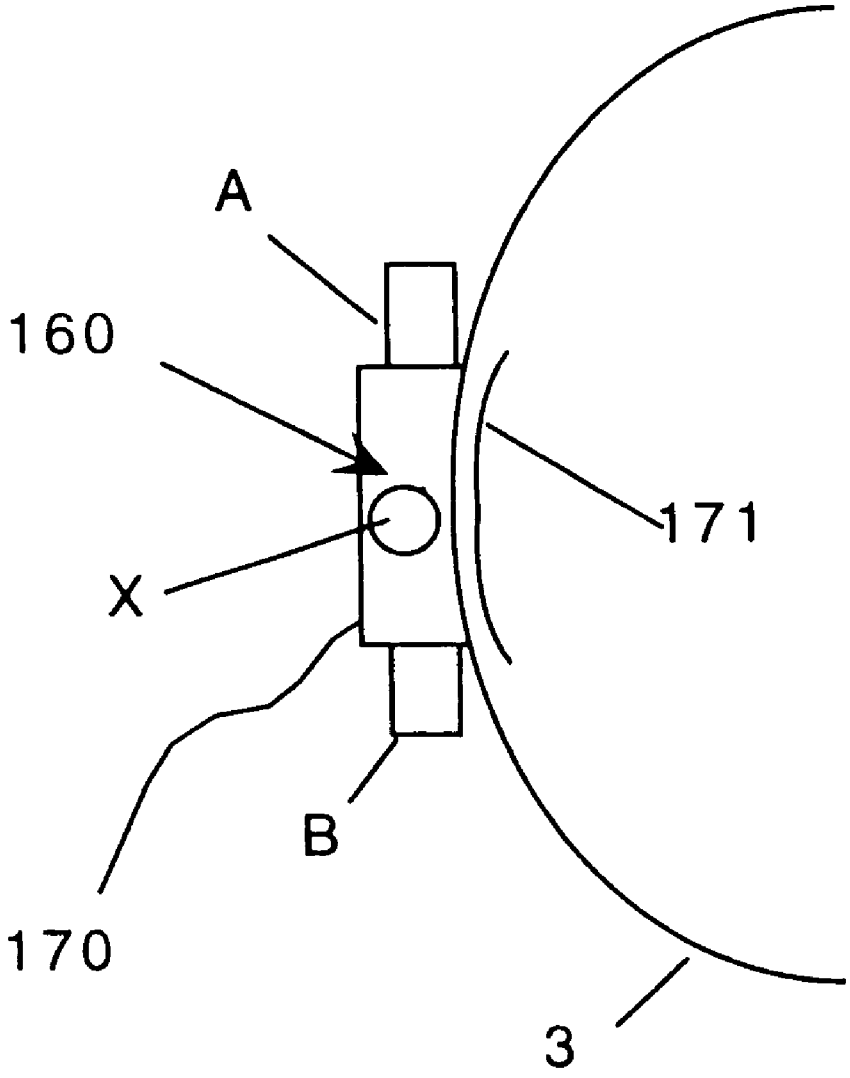
FIG. 3*c* is a top detail view of the forward tow bar attachment point.
Figure 4:
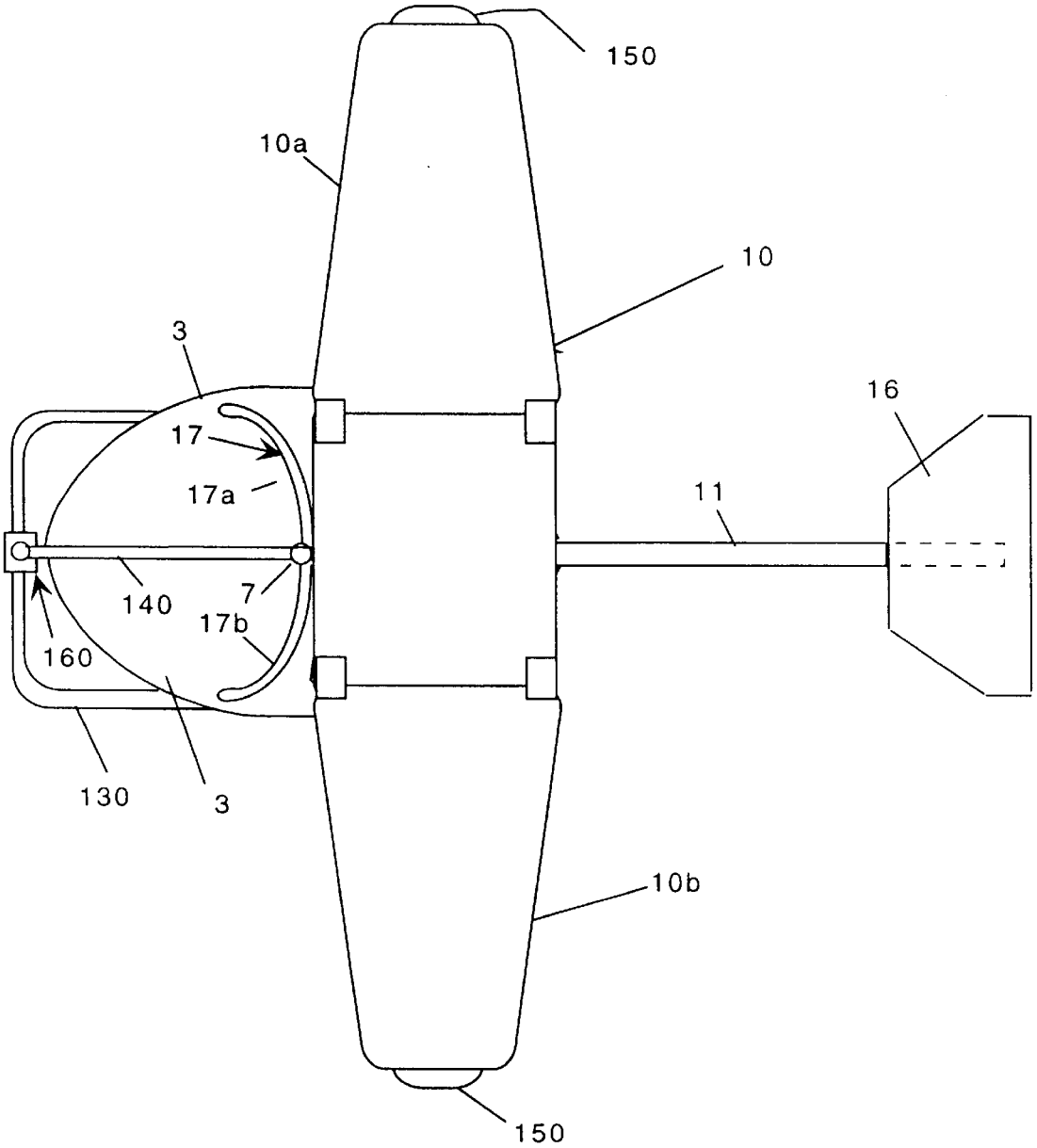
FIG. 4 is a top plan view of my tow sub with the dive plane in place.

A tow bar or compression strut 140 extends from the top of the cockpit 2, where it attaches to an internal frame 150 within the cockpit (see FIG. 2). The tow bar 140 is attached to the frame using a quick disconnect type fitting. As shown in FIGS. 1, 2, 3, 3*c* and 4, the tow bar 140 is attached to the lenses 3 and skids 130 using a quick disconnect assembly 160, which is discussed in more detail below. The tow bar is used to transfer their forward pull of the tow line to the tail boom and internal frame on top of the cockpit and to the front of the lens 3. The tow bar 140 is attached to the lens 3 using an anchoring plate 170 that has three quick disconnect fittings. The anchoring plate 170 is secured to the outside of the lens 3 and is through bolted to a doubler plate 171 on the inside of the lens 3. As shown, the tow bar 140 attaches to the anchoring plate 170 at point X. Two skids 130 attach to the anchoring plate 170 at points A and B. The tow bar is also used to attach the tow line 37, using a quick-release mechanism, as discussed below.

As shown in FIG. 2, in the preferred embodiment, an internal frame 150 is rigidly attached to the top of the cockpit 2 and the boom 11. The frame 150 provides a solid anchoring surface for the dive planes 10. The frame 150 is also used to evenly disperse the strain of the forward pull from the tow bar 140 and the downward thrust of the dive plane 10 to the cockpit 2 and the tail boom 11. Of course, a similar frame can be incorporated into the bottom of the cockpit 2 if the dive planes are to be placed there. Similarly, two separate frames can be incorporated into the sides of the cockpit 2 for side mounted dive planes.

A set of removable skids 130 are attached the sub as shown. The skids, or runners, are used to help move the sub on the ground. In the preferred embodiment, the skids meet the tow bar assembly 160 using the quick disconnects A and B.

The boom 11 extends back from the cockpit 2 for some distance. In the preferred embodiment, the typical boom length is about three to four feet. At the back 13 of the boom 11 are a pair of brackets 15 for mounting a rear elevator 16. If the optional foot stirrups (discussed below) are used, they are attached here as well. See, e.g., FIGS. 8–12.

Figure 5:
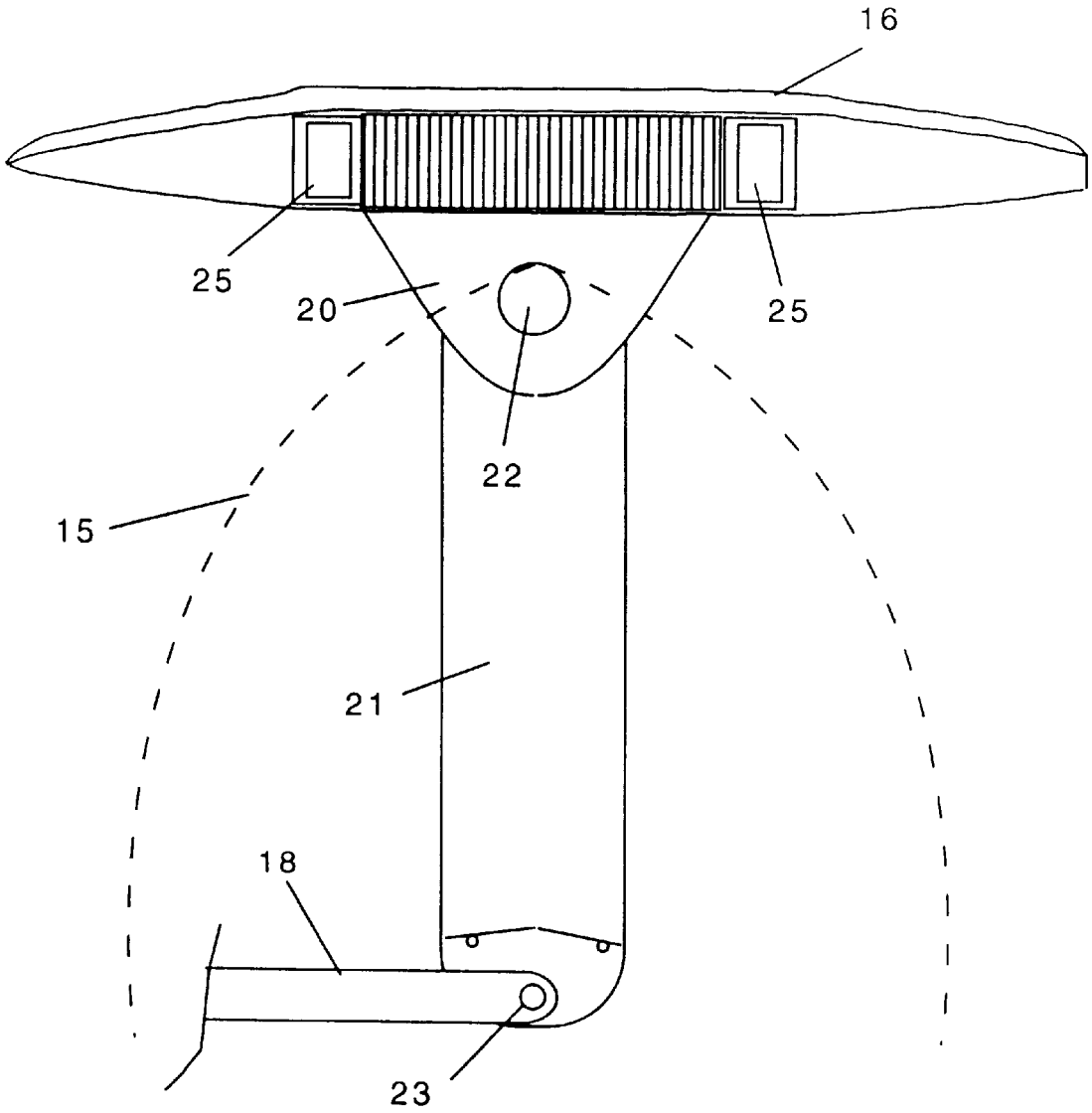
FIG. 5 is a side elevation detail view of the elevator and pivot bracket.

The rear elevator 16 is used for dive and assent control. Like the dive plane 10, the rear elevator 16 is made of a urethane or polyester foam core and is covered by an FRP material. The rear elevator 16 is operated by a control yoke 17, which is located in the cockpit 2. In the preferred embodiment, the control yoke 17 is made of a pair of curved handles 17*a* and 17*b*, as shown. The control yoke 17 attaches to a bell crank 19, which reverses the action of the yoke 17. The bell crank 19 then is attached to a sliding control arm 18 (see FIG. 2) that is placed in the boom 11. In the preferred embodiment, the bell crank 19 attaches directly to the yoke 17, however, the bell crank 19 may be positioned anywhere along the boom 11, up to a pivot arm 21. The operation action of this system is discussed in detail below. FIG. 5 shows that the rear elevator 16 sits on a fixed bracket 20 that is permanently attached to the elevator 16. This bracket 20 is attached to a pivot arm 21 by a pin 22, which acts as a pivot point for the elevator 16. The pivot arm 21 is attached to the sliding control arm 18 with a pin 23 as shown. To provide lateral stability for the pivot arm 21, the pivot arm 21 is sandwiched between the brackets 15, which are attached to the boom 11. Because the sliding control arm 18 is attached to the pivot arm 21, which is also attached to the rear elevator 16, the rear elevator pitches either upwards or downwards, pivoting about the pin 22, when the control arm 18 is activated. See FIG. 7 for illustration of this movement. The sliding control arm 18 is a rod that runs the length of the boom 11 and ends under the dive plane 10, where it attached to the bell crank 19 as discussed above. The sliding control arm disconnects in the middle of the shaft to allow for easy assembly and disassembly of the sub.

A diver 100 operates the control yoke 17, which rotates the bell crank 19 back and forth. The bell crank transfers the action of the yoke 17 to the control arm 18. Thus, the pivoting bracket 21 pivots the rear elevator 16 in the opposite direction to the control yoke 17. That is, if the control yoke 17 is pushed forward, the control arm 18 is pulled forward and the bottom of the pivoting bracket 21 (that part which is attached to the control arm 18) moves forward, which rotates the elevator 16 backwards, raising the tail of the sub, thus increasing the downward tilt of the dive plane 10, which causes the sub to go down, and vice versa.

Figure 6:
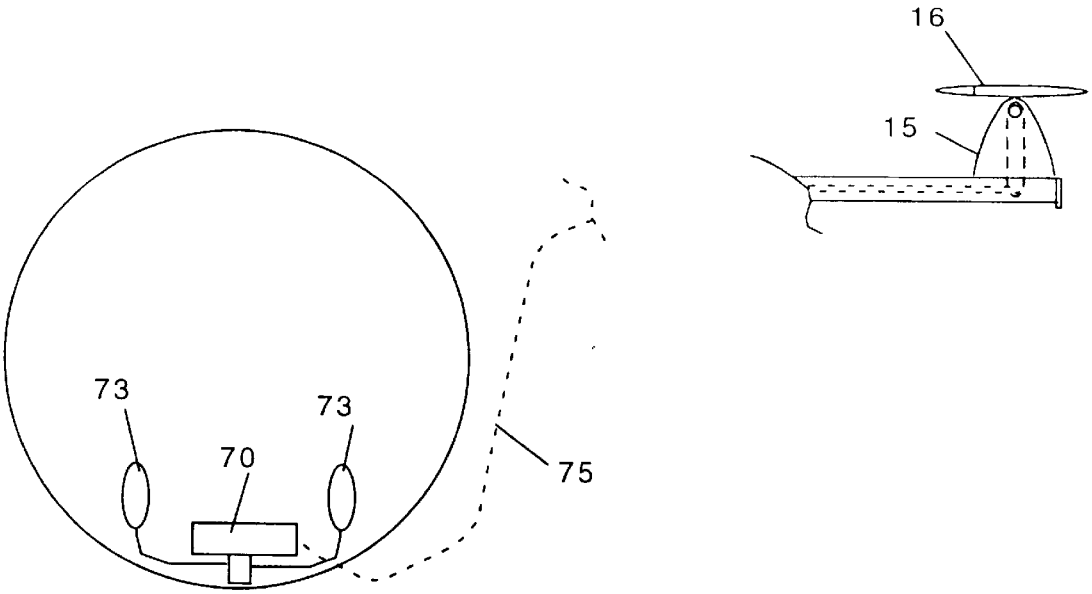
FIG. 6 is a partial component view of a cable control mechanism for the tow sub.
Figure 7:
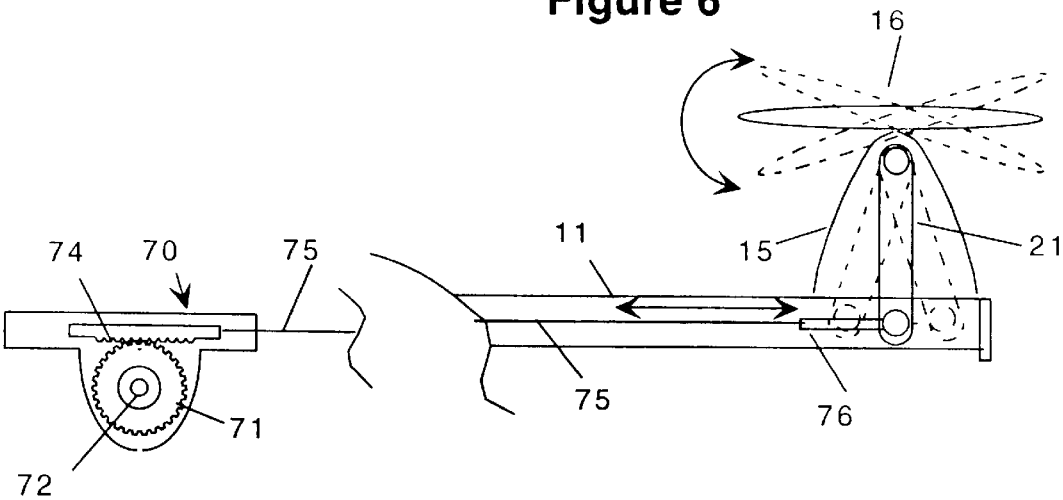
FIG. 7 is a partial cut-away view of the cable control mechanism for the tow sub.
Figure 8:
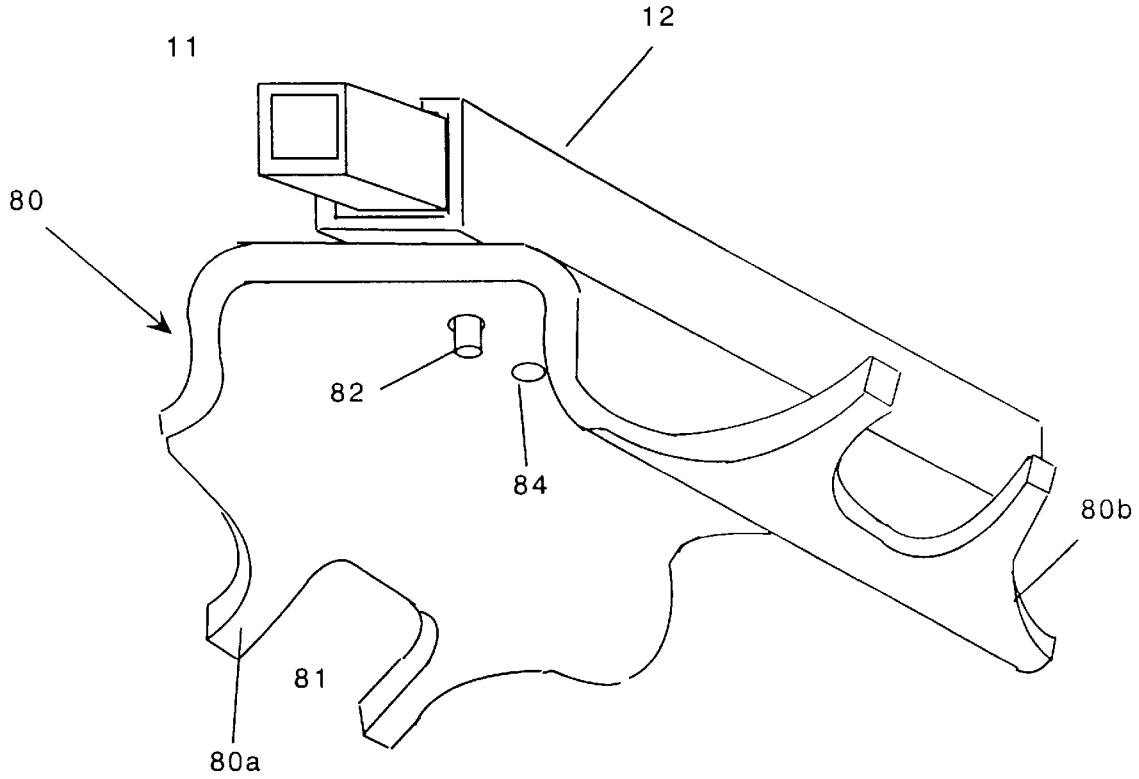
FIG. 8 is a perspective detail view of an optional stirrup control system.
Figure 9:
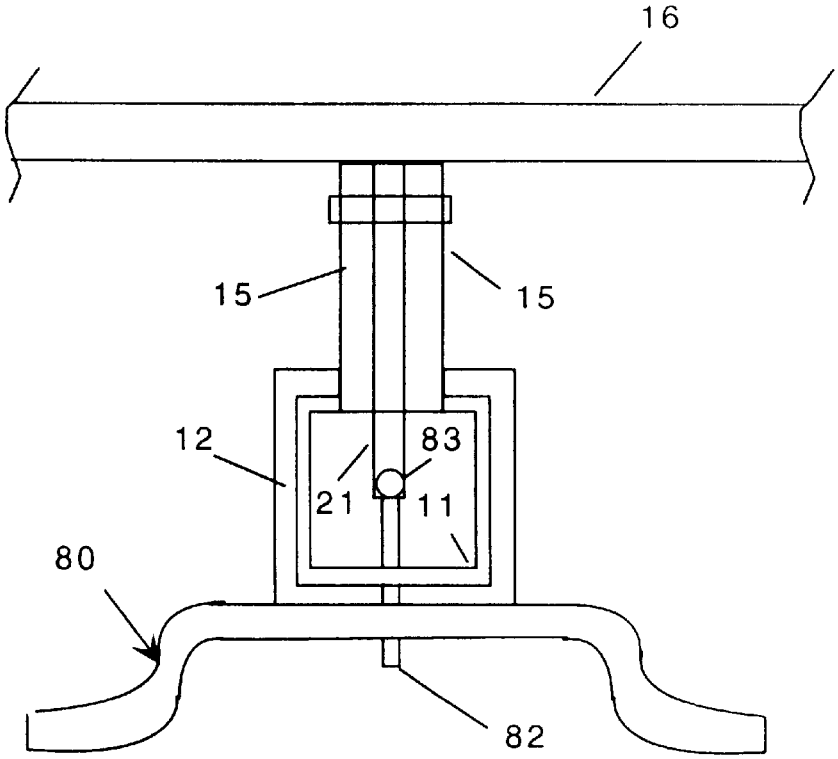
FIG. 9 is front elevation view of the optional stirrup control.
Figure 10:
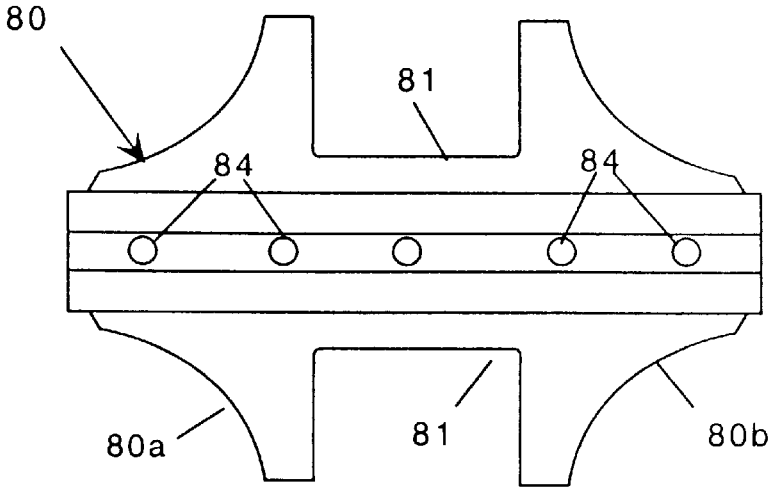
FIG. 10 is top plan view of the optional stirrup control.
Figure 11:
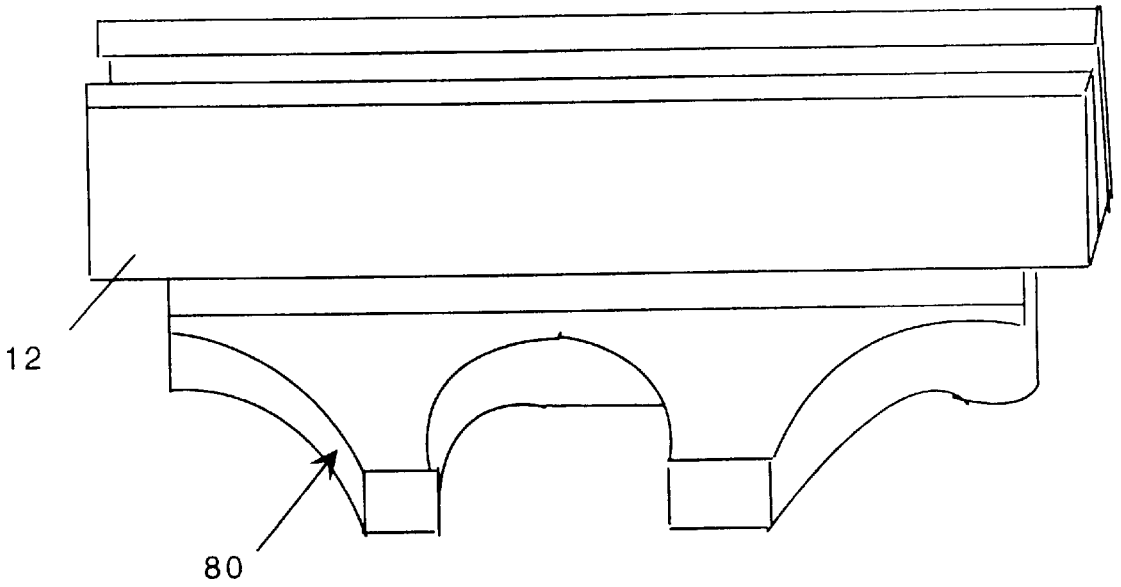
FIG. 11 is a detail perspective view of a stirrup.
Figure 12:
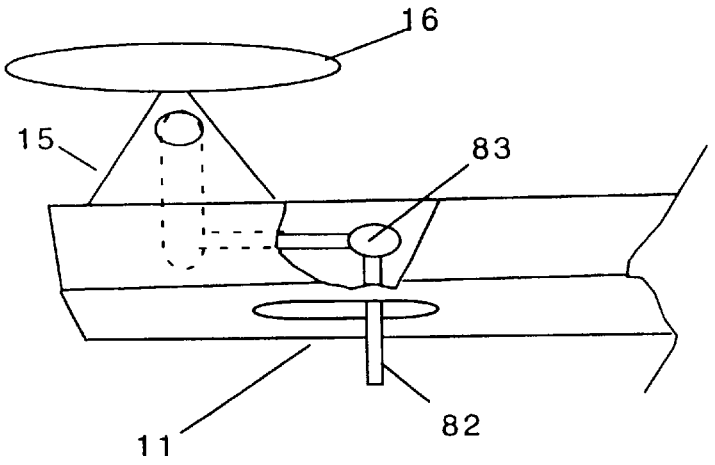
FIG. 12 is a detail view of the boom showing the stirrup shaft installed.

Referring now to FIGS. 6–7, an alternative operating mechanism uses a cable system in place of a yoke is shown. In this system, a standard push-pull type cable gearbox 70 is used to control the rear elevator 16. These gear boxes 70 are commonly used in small boats to control an engine. The gear box, 70 has a round gear 71 that connects to a shaft 72. The shaft has two handles 73 attached to the ends as shown. A gear rack 74 is connected to the top of the round gear 71 as shown. The gear rack 74 is connected to a control cable 75. As the handles 73 are pushed or pulled forward or back, the round gear 71 turns, causing the rack 74 to move forward or backward. This action, in turn, also moves the control cable back wards or forwards. FIG. 7 shows the control cable 75 attached to a bracket 76, which is connected to the pivot arm 21. Thus, any cable movement causes the pivot arm 21 to move as well, thereby moving the rear elevator 16. Of course, any similar type of operating mechanism can be used to achieve the same purpose.

One other optional control system uses a stirrup system that allows the diver to use his or her feet to control the elevator. This then frees the diver's hands for photography or other operations. Referring now to FIGS. 8–12, the stirrup 80 has tapered front and back ends 80*a* and 80*b* as shown. See FIG. 9. Two notches 81 are provided to hold the diver's foot during use. See FIG. 10. The ends 80*a* and 80*b* are tapered so that a diver's foot can easily slide back or forward along the boom 11 and find the notches 81 for his foot. Two notches 81 are provided so that either foot can be used to slide the stirrup 80 either forward or aft.

The stirrups 80 are connected to the sliding control linkage via a shaft 82 (see FIG. 12) that connects to the stirrup linkage 83 as shown. Several holes 84 are provided to allow the stirrups to be adjusted along the shaft, to best fit the diver. See, FIGS. 8 and 10.

The stirrups can be used in conjunction with the control systems discussed above, or can be operated alone, as desired. The boom 11 is slotted to allow the shaft 82 to slide fore or aft without binding. The stirrups 80 are attached to a sleeve 12 that fits over the boom 11. This sleeve is slotted along its top so it does not hit the elevator brackets.

This construction maintains the position of the stirrups with respect to the boom and prevents the stirrups from pivoting about the connecting shaft. In this way, the boom 11 acts as a track on which, the stirrups slide.

Figure 13:
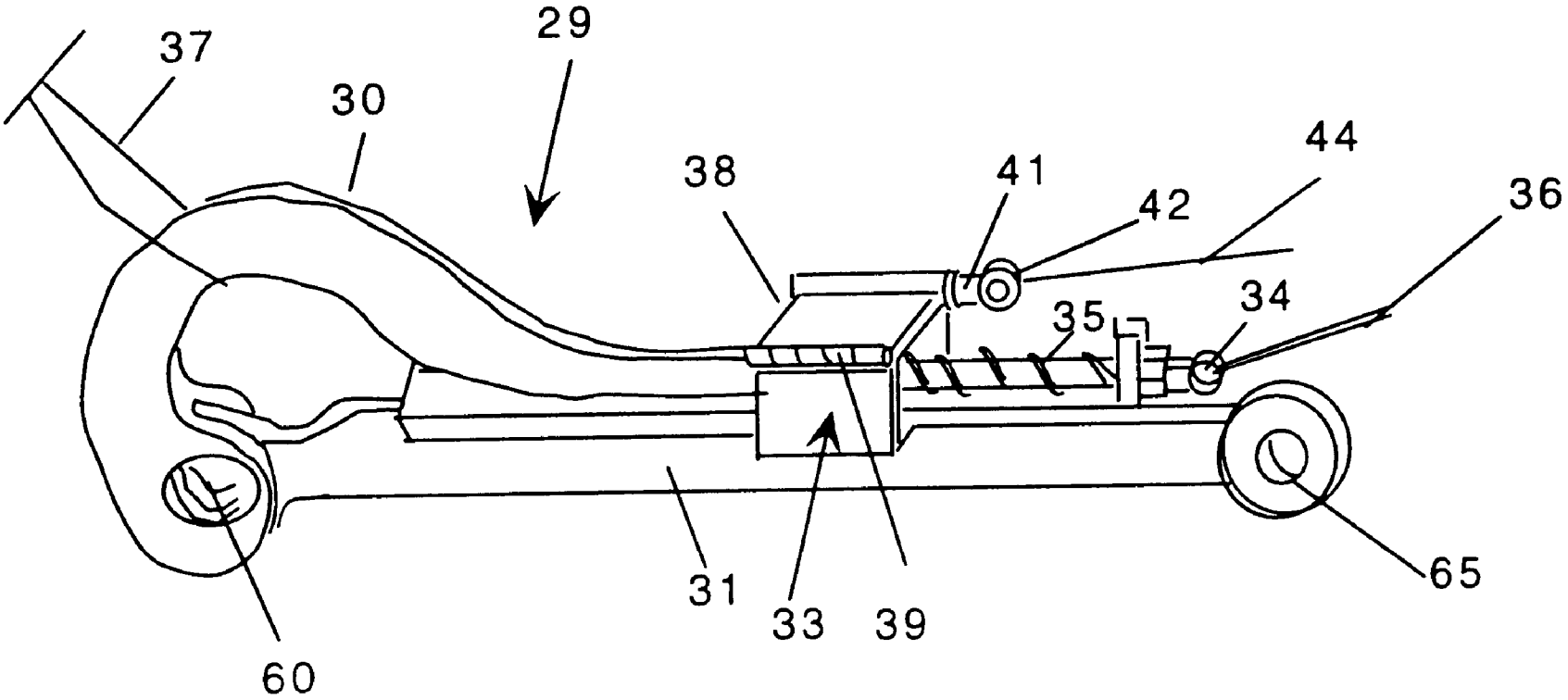
FIG. 13 is a perspective view of a quick release mechanism.
Figure 14:
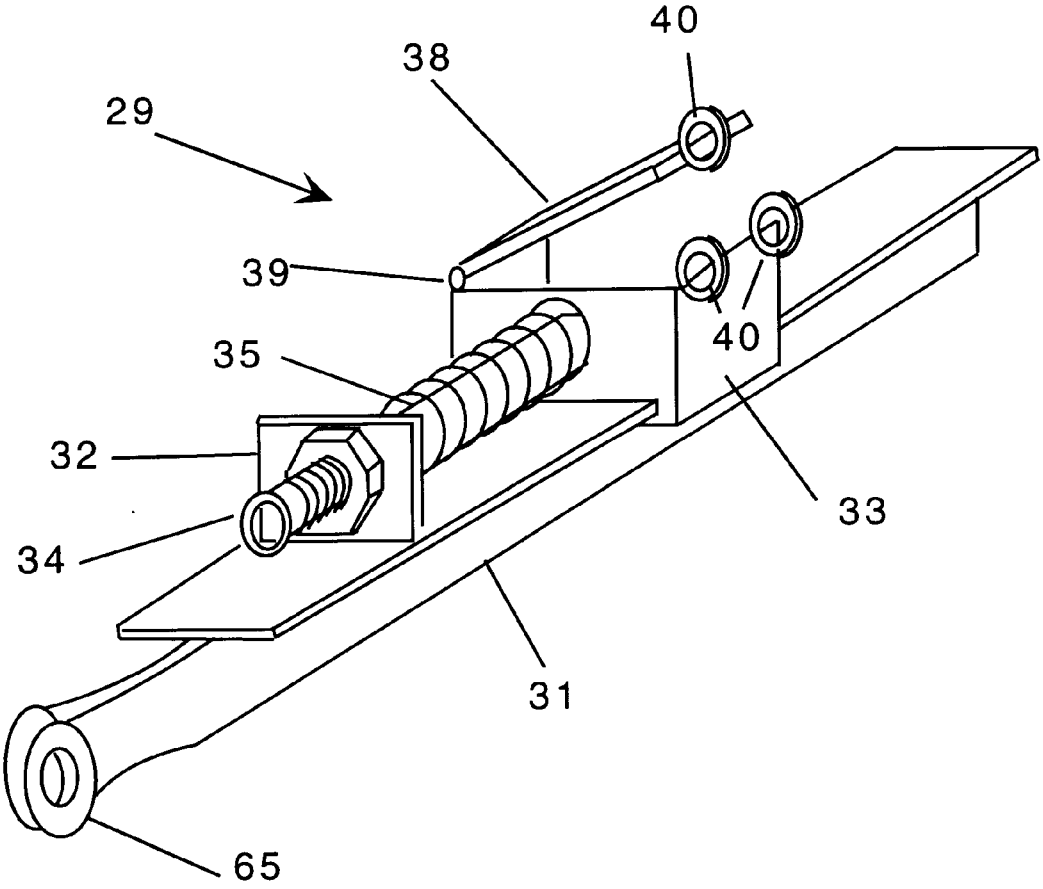
FIG. 14 is a detail view of the emergency release feature of the quick release mechanism.

Referring now to FIGS. 13 and 14, details of one type of quick release mechanism 29 are shown. This system has two purposes. First, it acts to disconnect the tow sub from the towing vessel. By using a control line (discussed below), the diver 100 can release the hook without having to leave the sub. Second, an emergency release is also provided so that if a diver must make a fast exit from the sub, a lanyard secured to the diver's wrist, releases the hook as well.

The system uses a hook 30, such as a pelican hook, which is attached to a shaft 31. The shaft 31 runs through a locking box 33 as shown. An eye bolt 34 extends rearward from the locking box 33 as shown. The eye bolt 34 then runs through a fixed bracket 32. A spring 35 is placed between the bracket 32 and the locking box 33. The spring provides a forward bias on the eye bolt 34 that maintains the locking box 33 in a forward position with respect to the shaft 31. A release line 36 is attached to the eye bolt 34 as shown. The tow line 37, with a loop on the end, is clipped onto the hook 30. Once the tow line 37 is in place, the hook 30 is slipped under the forward edge of the locking box 33. In this configuration, the tow sub 1 can be freely towed. To provide for smooth operation, the hook 30 is attached using a pivot pin 60.

The quick disconnect mechanism 29 is designed to pivot at the connection to the sub 1. A ring 65 is attached at the back of the system 29. It is this ring 65 that attaches to the sub. In this way, quick disconnect system 29 matches the angle of the tow line 37.

If the diver 100 chooses to release the sub 1, the diver 100 simply pulls the release line 36. This causes the eye bolt 34 to pull the locking box 33 backward, which releases the hook 30, thereby releasing the tow line 37.

If there is an emergency, e.g., where the diver is forced out of the sub 1, or simply panics, an emergency release is provided. At the top 38 of the locking box 33 is a hinge 39. At the opposite edge of the top 38 of the locking box 33 are three rings 40. A pin 41 passes through the rings 40 and secures the top 38 of the locking box 33. The pin 41 has an eye 42. A lanyard 44 is tied to the eye 42. The lanyard 44 is then passed through the sub cockpit 2 and is then clipped to the diver's wrist. If the diver 100 leaves the sub 1 for any reason, the lanyard 44 pulls the pin 41 out of the rings 40. This releases the top 38 of the locking box 33, which then releases the hook 30. The pin 41 can have a spring-loaded detent mechanism to prevent the pin 41 from slipping out of the rings 40. This detent is not designed to impede removal of the pin 41 under tension on the lanyard 44. Once the hook is released, the sub 1 stops. Of course, any other type of quick release mechanism that is compatible with the tow sub and the required functions of the release, can be used.

In the preferred embodiment, the entire sub 1 is designed to break down for transportability. This is accomplished using standard quick disconnect type fittings. The sub 1 can be broken down in a number of ways. For example, the skids 130 can be removed, the dive planes 10*a* and 10*b* can be removed, the boom 11 and elevator 16 can be disassembled, the cockpit 2 can be made of two sections and the lenses 3 can be two sections. Obviously, any combination of components can be made to breakdown for convenience. It is only a matter of placing the fittings to accomplish this.

Accessories, such as an anchor bag or storage bags can be attached to the sub for the convenience of the diver. Instruments, such as a depth gauge, time or speed gauges can be placed in the cockpit as well.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A tow sub for being towed underwater behind a pulling vehicle using a tow line, comprising:

a) a generally cylindrical cockpit, having an open back, and a top;

b) a dive plane, fixedly attached to said generally cylindrical cockpit;

c) a boom, fixedly attached to the top of generally cylindrical cockpit, and extending backwardly therefrom;

d) a rear elevator, pivotably attached to said boom; and e) a means for controlling the rear elevator, such that said rear elevator can be pivoted through a range of motion to reach a desired operating angle.

2. The tow sub of claim 1 further comprising at least one lens, fixedly installed within said generally cylindrical cockpit.

3. The tow sub of claim 1 wherein the means for controlling the rear elevator comprise:

a) a control yoke, operable installed within said generally cylindrical cockpit;

b) a bell crank attached to said control yoke;

c) a control arm, slidably installed within said boom, and being operably attached to said bell crank, whereby said bell crank transfers the motion of the control yoke to the control arm; and d) a pivot arm, attached to said control arm, and also being pivotably attached to said rear elevator, whereby when said control yoke is pushed forward, said control arm is slid forward, which causes said pivot arm to be pulled forward, which then causes said rear elevator to be pivoted rearward and upward and when said control yoke is pulled rearward, said control arm is slid rearward, which causes said pivot arm to be pushed rearward, which then causes said rear elevator to be pivoted forward and downward.

4. The tow sub of claim 1 further including a means for attaching a tow line to said tow sub.

5. The tow sub of claim 4 wherein said means for attaching a tow line includes a quick release mechanism.

6. The tow sub of claim 5 wherein the quick release mechanism further includes an emergency release mechanism.

7. The tow sub of claim 6 wherein the quick release mechanism includes:

a) a hook, having a support shaft;

b) a means for restraining the hook, slidably attached to said support shaft; and c) a means for sliding said means for restraining the hook, fixedly attached to said means for restraining the hook, and also being operably installed within said generally cylindrical cockpit.

8. The tow sub of claim 7 wherein the means for restraining the hook includes a box having a top, hingably attached to said box.

9. The tow sub of claim 8 wherein the emergency release mechanism further includes an emergency release pin, removably attached to said box top; and a lanyard, fixedly attached to said emergency release pin, whereby when a diver pulls on said lanyard, said emergency release pin is removed from said box, causing the top of said box to open, thereby releasing said hook.

10. The tow sub of claim 1 wherein the means for controlling the rear elevator comprise:

a) a push-pull cable gear box, fixedly mounted in said generally cylindrical cockpit;

b) at least one control lever, operably attached to said push-pull cable gear box;

c) a means for translating movement of said control lever from rotational movement to linear movement;

d) a control cable, fixedly attached to said means for translating movement of said control lever from rotational movement to linear movement;

e) a pivot arm, attached to said control cable, and also being pivotably attached to said rear elevator, whereby when said control cable is pushed forward said pivot arm is pulled forward, which then causes said rear elevator to be pivoted backward and upward, and when said control cable is pulled rearward, said pivot arm is slid backward, which then causes said rear elevator to be pivoted forward and downward.

11. The tow sub of claim 1 wherein the means for controlling the rear elevator comprise:

a) a pivot arm, attached to said rear elevator, whereby when said pivot arm is pulled forward, said rear elevator is pivoted backward and upward, and when said pivot arm is slid backward rear elevator is pivoted forward and downward, said pivot arm having a bottom, said bottom of said pivot arm extending into said boom;

b) a link member, being operably attached to the bottom of said pivot arm and being located within said boom;

c) a shaft, having a first end and a second end, the first end of said shaft being fixedly attached to said link member, and the second end of said shaft extending outwardly through a slot in said boom; and d) at least one foot stirrup, operably attached to said second end shaft, and being positioned outside of said boom, such that a foot of a diver being positioned in said foot stirrup can move said rear elevator by moving said foot stirrup forward or backward.

12. A tow sub for being towed underwater behind a pulling vehicle using a tow line, comprising:

a) a generally cylindrical cockpit, having a lens, an open back, and a top;

b) a dive plane, fixedly attached to said generally cylindrical cockpit, wherein said dive plane is formed of two, removable, pieces;

c) a boom, fixedly attached to the top of generally cylindrical cockpit, and extending backwardly therefrom;

d) a rear elevator, pivotably attached to said boom; and e) a means for controlling the rear elevator, such that said rear elevator can be pivoted through a range of motion to reach a desired operating angle.

13. The tow sub of claim 12 wherein the means for controlling the rear elevator comprise:

a) a push-pull cable gear box, fixedly mounted in said generally cylindrical cockpit;

b) at least one control lever, operably attached to said push-pull cable gear box;

c) a means for translating movement of said control lever from rotational movement to linear movement;

d) a control cable, fixedly attached to said means for translating movement of said control lever from rotational movement to linear movement;

e) a pivot arm, attached to said control cable, and also being pivotably attached to said rear elevator, whereby when said control cable is pulled forward said pivot arm is pulled forward, which then causes said rear elevator to be pivoted backward and upward, and when said control cable is pushed rearward, said pivot arm is slid backward, which then causes said rear elevator to be pivoted forward and downward.

14. The tow sub of claim 12 further including a means for attaching a tow rope to said tow sub.

15. The tow sub of claim 14 wherein said means for attaching a tow rope includes a quick release mechanism.

16. The tow sub of claim 15 wherein the quick release mechanism further includes an emergency release mechanism.

17. The tow sub of claim 15 wherein the quick release mechanism includes:

a) a hook, having a support shaft;

b) a means for restraining the hook, slidably attached to said support shaft; and c) a means for sliding said means for restraining the hook, fixedly attached to said means for restraining the hook, and also being operably installed within said generally cylindrical cockpit.

18. The tow sub of claim 17 wherein the means for restraining the hook includes a box having a top, hingably attached to said box.

19. The tow sub of claim 16 wherein the emergency release mechanism further includes an emergency release pin, removably attached to said box top; and a lanyard, fixedly attached to said emergency release pin, whereby when a diver pulls on said lanyard, said emergency release pin is removed from said box, causing the top of said box to open, thereby releasing said hook.

20. The tow sub of claim 12 wherein the means for controlling the rear elevator comprise:

a) a pivot arm, attached to said rear elevator, whereby when said pivot arm is pulled forward, said rear elevator is pivoted backward and upward, and when said pivot arm is slid backward rear elevator is pivoted forward and downward, said pivot arm having a bottom, said bottom of said pivot arm extending into said boom;

b) a link member, being operably attached to the bottom of said pivot arm and being located within said boom;

c) a shaft, having a first end and a second end, the first end of said shaft being fixedly attached to said link member, and the second end of said shaft extending outwardly through a slot in said boom; and d) at least one foot stirrup, operably attached to said second end shaft, and being positioned outside of said boom, such that a foot of a diver being positioned in said foot stirrup can move said rear elevator by moving said foot stirrup forward or backward.

* * * * *